US010486161B2

(12) United States Patent
Goosen

(10) Patent No.: US 10,486,161 B2
(45) Date of Patent: Nov. 26, 2019

(54) PULVERISER MILL

(71) Applicant: COAL MILLING PROJECTS (PTY) LIMITED, Emalahleni (ZA)

(72) Inventor: Pierre Goosen, Port Elizabeth (ZA)

(73) Assignee: COAL MILLING PROJECTS (PTY) LIMITED, Emalahleni (ZA)

( * ) Notice: Subject to any disclaimer, the term of this patent is extended or adjusted under 35 U.S.C. 154(b) by 638 days.

(21) Appl. No.: 15/035,773

(22) PCT Filed: Dec. 12, 2014

(86) PCT No.: PCT/IB2014/066834

§ 371 (c)(1),
(2) Date: May 11, 2016

(87) PCT Pub. No.: WO2015/087286

PCT Pub. Date: Jun. 18, 2015

(65) Prior Publication Data

US 2016/0303573 A1 Oct. 20, 2016

(30) Foreign Application Priority Data

Dec. 12, 2013 (ZA) ..... 2013/09420

(51) Int. Cl.
*B02C 15/00* (2006.01)

(52) U.S. Cl.
CPC ..... *B02C 15/001* (2013.01); *B02C 15/00* (2013.01); *B02C 15/003* (2013.01)

(58) Field of Classification Search
CPC ..... B02C 15/001; B02C 15/003
(Continued)

(56) References Cited

U.S. PATENT DOCUMENTS 4,264,041 A 4/1981 Kitto, Jr. et al.
4,721,258 A 1/1988 Dougan et al.
(Continued)

FOREIGN PATENT DOCUMENTS

GB 810915 A 3/1959
WO WO-01/56699 A1 8/2001

OTHER PUBLICATIONS

International Preliminary Report on Patentability, International application No. PCT/IB2014/066834, dated Jun. 14, 2016.
(Continued)

*Primary Examiner* — Elaine Gort
*Assistant Examiner* — Christopher B Wehrly
(74) *Attorney, Agent, or Firm* — Marshall, Gerstein & Borun LLP

(57) ABSTRACT

The invention relates to a pulveriser mill which includes a rotary grinding member and a port ring (10) which is arranged around a periphery of the rotary grinding member for rotation with the rotary grinding member about an axis. The port ring (10) includes a plurality of vanes (22) which are angularly spaced about the axis in a configuration which allows air to flow from below the port ring (10) to above the port ring (10). The vanes (22) are inclined with respect to the vertical and have an operatively upstream end and a downstream end and a non-planar, arcuately curved leading surface (24) which extends between the upstream end and the downstream end. The vanes (22) furthermore have a non-uniform radial width in the axial direction.

17 Claims, 7 Drawing Sheets

(58) Field of Classification Search
USPC ..... 241/57, 119
See application file for complete search history.

(56) References Cited

U.S. PATENT DOCUMENTS

| | | | | | |
|---|---|---|---|---|---|
| 4,953,793 | A | | 9/1990 | Kiefer et al. | |
| 5,090,631 | A | * | 2/1992 | Wark | B02C 15/001 241/119 |
| 5,186,404 | A | | 2/1993 | Wark | |
| 5,263,855 | A | * | 11/1993 | Watson | B02C 15/001 241/119 |
| 5,667,149 | A | | 9/1997 | Eisinger | |
| 5,908,167 | A | * | 6/1999 | Provost | B02C 15/001 241/119 |

OTHER PUBLICATIONS

International Search Report and Written Opinion, International Application No. PCT/IB2014/066834, dated Mar. 26, 2015.

* cited by examiner

PULVERISER MILL

FIELD OF INVENTION

This invention relates to a pulveriser mill for crushing or grinding raw material, for e.g. fossil fuels, into fine particles suitable for combustion in a fossil fuel furnace. In particular, the invention relates to a rotatable throat or port ring of the mill which is provided around a periphery of a rotary grinding member of the mill.

BACKGROUND OF INVENTION

A pulveriser mill has a rotary grinding table or yoke, known as a grinding ring, which in most applications is positioned below a stationary upper ring, known as a top ring. The grinding ring is configured to rotate about a vertical rotation axis whilst the top ring remains stationary. A number of grinding elements in the form of steel balls is provided between the top ring and the grinding ring in order to crush raw material fed into the mill in gyratory fashion. That said, the grinding elements may be fixed or may be free to precess. A passage or air port is provided between an outer periphery of the grinding ring and an inner surface of the housing of the mill. Air sweeps upward through the air port and transports fines (crushed raw material) to a classifier provided above the top ring.

A port ring or rotatable throat is provided in the passage and is mounted around the outer periphery of the grinding ring such that it is co-rotatable therewith. The throat includes a plurality of inclined, planar vanes which project radially outwardly and are angularly spaced apart such that openings are defined between the vanes to allow air to flow from below the grinding ring to above the grinding ring.

In conventional pulveriser mills, as air passes through the throat from a plenum chamber below the grinding ring, it undergoes rapid acceleration as well as a change in direction which creates a large pressure shock which is undesirable and gives rise to an increased pressure drop across the mill. As a result of an increased pressure drop, the mill consumes more energy which leads to a reduction in efficiency as well as a reduction in mill throughput.

The Applicant desires a pulveriser mill which at least alleviates the above drawbacks.

SUMMARY OF INVENTION

In accordance with the invention, there is provided a pulveriser mill which includes a rotary grinding member and a port ring which is arranged around a periphery of the rotary grinding member for rotation with the rotary grinding member about an axis, the port ring including a plurality of vanes which are angularly spaced about the axis in a configuration which allows air to flow from below the port ring to above the port ring, at least one of the vanes having an operatively upstream portion and a downstream portion and a non-planar leading surface which extends between the upstream portion and the downstream portion.

The non-planar leading surface may be curved. More particularly, the leading surface may have a concave curvature. Alternatively, the leading surface may have a convex curvature. In a different embodiment, the leading surface may have a serpentine or undulating curvature.

The vane may be inclined relative to the vertical and the upstream portion may have an upstream end and the downstream portion may have a downstream end, the non-planar leading surface extending between the upstream end and the downstream end.

A line tangential to the leading surface drawn from one of the upstream end or the downstream end may not pass through the other end when the vane is viewed radially. A line tangential to the leading surface drawn from the upstream end may form a first angle relative to the vertical which is greater than a second angle formed between a line tangential to the leading surface drawn from the downstream end and the vertical, when the vane is viewed radially. Therefore, a straight line projection of the upstream end is staggered relative to a straight line projection of the downstream end when the vane is viewed radially.

At least one of the vanes may have a curved cross-sectional profile when viewed radially. The vanes may be arcuately curved when viewed radially.

At least one of the vanes may have a cross-sectional profile which diverges, when viewed radially, from the upstream portion to the downstream portion.

The port ring may define a plurality of openings between the vanes, the ring having an upstream inlet which is defined in part by upstream ends of adjacent vanes and a downstream outlet defined in part by downstream ends of adjacent vanes such that the openings between adjacent vanes converge or decrease in area from the inlet to the outlet. Alternatively, each vane may have a teardrop or aerofoil cross-sectional profile when viewed radially. A leading surface of each vane extending between an upstream portion and a downstream portion may be inclined with respect to the vertical and may have a curved cross-sectional profile when viewed radially.

Each vane may have a triangular cross-sectional profile when viewed radially. Furthermore, each vane may be a composite vane comprising a first leading member, a second trailing member diverging from the leading member in a downstream direction at an upstream end of the vane and a third downstream member extending circumferentially between the leading member and the trailing member. The vanes may have a non-uniform radial width in the axial direction.

Each vane may be inclined with respect to the vertical and may have an upstream end and a downstream end, a radial width of the upstream end being greater than a radial width of the downstream end.

At least one side of the vane may be slanted when the vane is viewed face on. Furthermore, opposing sides of the vane may converge toward the downstream end when the vane is viewed face on such that the vane tapers from the upstream end to the downstream end.

The invention extends to a method of modifying a pulveriser mill which includes a rotary grinding member and a port ring arranged around a periphery of the rotary grinding member for rotation with the rotary grinding member about an axis, the port ring including a plurality of inclined planar vanes, the method including replacing the port ring with a port ring including a plurality of vanes which are angularly spaced about the axis in a configuration which allows air to flow from below the port ring to above the port ring, wherein at least one of the vanes has an operatively upstream portion and a downstream portion and a non-planar leading surface which extends between the upstream portion and the downstream portion.

According to yet another aspect of the invention, there is provided a pulveriser mill including a rotary grinding member and a port ring which is arranged around a periphery of the rotary grinding member for rotation with the rotary grinding member about an axis, the port ring including a plurality of vanes which are angularly spaced about the axis in a configuration which allows air to flow from below the port ring to above the port ring, at least one of the vanes having a cross-sectional profile which diverges, when viewed radially, from an upstream portion to a downstream portion.

BRIEF DESCRIPTION OF DRAWINGS

The invention will now be further described, by way of example, with reference to the accompanying diagrammatic drawings.

In the drawings.

DETAILED DESCRIPTION OF AN EXAMPLE EMBODIMENT

Figure 1:
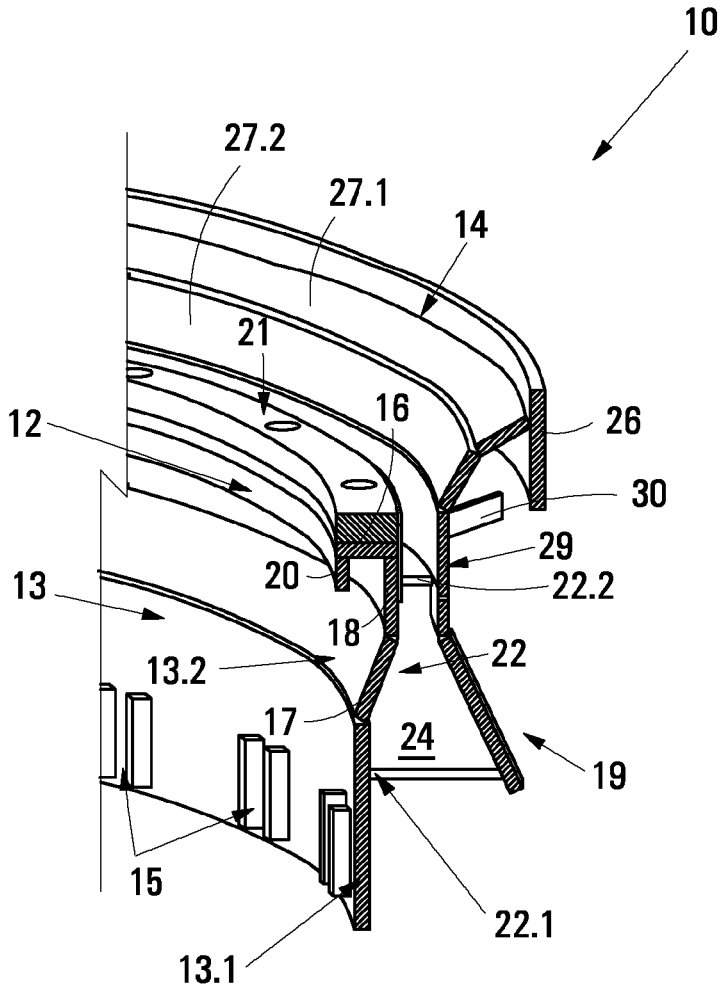
FIG. 1 illustrates a radial cross-section through a rotatable throat or port ring of a pulveriser mill in accordance with the invention.
Figure 2:
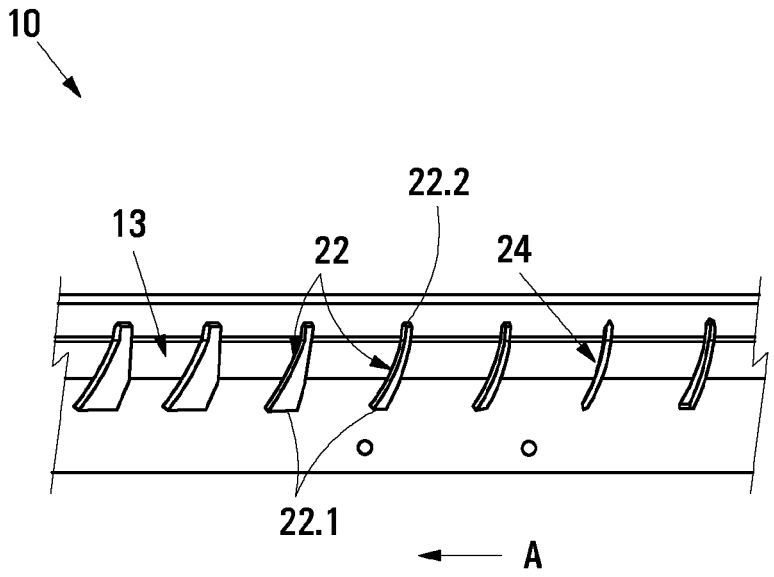
FIG. 2 illustrates part of the rotatable throat illustrated in FIG. 1, viewed radially, in which an outer ring has been omitted for the sake of clarity.
Figure 3:
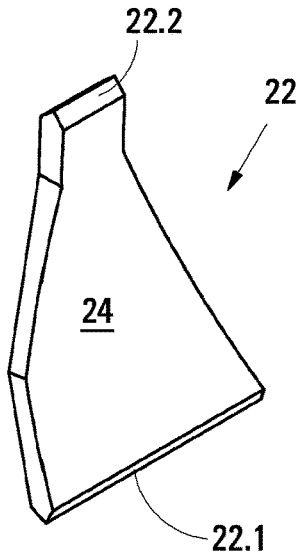
FIG. 3 illustrates a three-dimensional view of a vane forming part of the throat illustrated in FIGS. 1 and 2.

The operation of vertical pulveriser mills is well known to those skilled in the art and will therefore not be expounded upon in the description that follows. In FIGS. 1 and 2, reference numeral 10 refers generally to a first embodiment of a rotatable throat, or port ring, which forms part of a pulveriser mill in accordance with the invention. In order to simplify installation, the throat or port ring 10 comprises a plurality of segments which are mounted around a periphery of a rotary grinding ring (not shown) of the pulveriser mill for rotation therewith about a rotation axis. The throat 10 is provided in an air port or passage which is defined by a radially outer periphery of the grinding ring and an inner wall of a housing of the mill. As the throat 10 rotates about the axis, air flows from below the grinding ring to above the grinding ring through openings provided in the throat 10 and sweeps crushed particulate material (fines) upward to a classifier in which the particulate material is classified according to size.

The throat 10 comprises a rotor 12 which includes a plurality of segments (not illustrated) which are attached to the grinding ring for rotation therewith and are interconnected at angularly spaced positions around the periphery of the grinding ring. The throat 10 further includes a stator 14 which is attached to the inner wall of the housing of the pulveriser mill.

The rotor 12 comprises an inner ring 13 which includes a plurality of angularly spaced apart mounting formations 15 for attaching the inner ring 13 to the grinding ring of the mill. The inner ring 13 comprises an annular, upright lower section 13.1 and a partially outwardly and upwardly slanted upper section 13.2. The upper section 13.2 comprises a frusto-conical panel 17 which is connected to the upright lower section 13.1 below, an upright panel 18 which is connected to the frusto-conical panel 17 below, a horizontal disc 16, a radially outer edge of which is connected to an upper edge of the upright panel 18 and a depending lip 20 which depends from a radially inner edge of the horizontal disc 16. The depending lip 20 is configured to hook around an edge of the grinding ring. A dam ring 21 is provided on top of the horizontal disc 16 and overlaps connection points of the segmented disc 16 below in order to rigidify the inner ring 13.

The rotor 12 further includes a partially outwardly and downwardly slanted outer ring 19 which is radially spaced from the inner ring 13. A plurality of angularly spaced apart vanes 22 extend between the inner ring 13 and the outer ring 19.

With reference to FIG. 2, as mentioned previously, air flows from below the throat 10 upwards through openings defined between adjacent vanes 22. Accordingly, each vane 22 has an operatively upstream end 22.1 and an operatively downstream end 22.2. In FIG. 2, the direction of rotation is indicated by arrow A. Hence, the upstream end 22.1 of each vane 22 leads and the downstream end 22.2 trails. Accordingly, each of the vanes 22 is inclined with respect to the vertical at an angle of between 1° to 20°, preferably 18°. Contrary to conventional throats, the vanes 22 of the throat 10 in accordance with the invention have an arcuate profile when viewed radially. Furthermore, each of the vanes 22 exhibits a non-uniform radial width in the axial direction (see FIG. 1). In other words, each vane 22 tapers from a broad upstream end 22.1 to a narrower downstream end 22.2. The curvature of each vane 22 is such that a leading face 24 which extends between the ends 22.1, 22.2 is concavely curved. In the example embodiment illustrated, the vanes are regularly spaced apart. Inner and outer side edges of each vane 22 match the profiles of the inner and outer rings 13, 19 respectively. It is to be appreciated that a cross-sectional profile of the inner ring 13 may vary from the example embodiment illustrated, i.e. the profile may extend straight up and may be absent of the frusto-conical panel 17.

Figure 4:
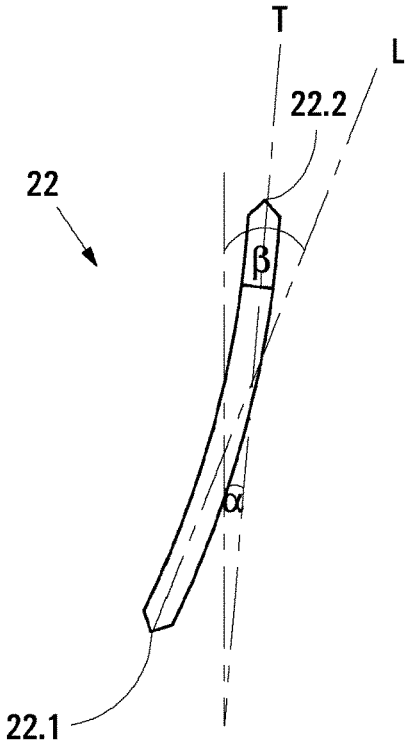
FIG. 4 shows a radially outer side view of the vane of FIG. 3.

Referring now to FIG. 4, a straight line projection L drawn from the upstream end 22.1 of the vane 22 when viewed radially forms a first angle $\beta$ with respect to the vertical. Depending on the installation, $\beta$ may range from 10° to 80° inclusive. The correct angle of $\beta$ is calculated based on the relationship of air velocity over the vane inlet (upstream end) and the rotational velocity of the grinding ring. Moreover, a straight line projection T drawn from the downstream end 22.2 forms a second angle $\alpha$ with respect to the vertical which is smaller than the first angle $\beta$. The second angle $\alpha$ may range from 1° to 20° inclusive. Again, the correct angle of $\alpha$ is calculated based on the relationship of air velocity at the vane exit (downstream end) and the rotational velocity of the grinding ring. Accordingly, the straight line projections L, T of the ends 22.1, 22.2 are staggered with respect to one another.

Referring back to FIG. 1, the stator 14 includes a wall ring 26 which is operatively attached to the inner wall of the housing of the mill. The wall ring 26 has a plurality of holes whereby the ring 26 is attached to the wall using suitable fasteners. The stator 14 further includes a first frusto-conical ledge cover 27.1 which extends downwardly and inwardly from the wall ring 26. Attached to the first ledge cover 27.1 is a second frusto-conical ledge cover 27.2 which extends downwardly and inwardly at a steeper angle than the first ledge cover 27.1, the ledge covers 27 collectively having a rectilinear profile when seen in cross-section. An annular panel 29 depends from a lower edge of the second conical ledge cover 27.2 such that it is in register with an upper edge of the outer ring 19 of the rotor 12 and defines a small annular gap therebetween. The stator 14 further includes a plurality of gussets or brackets 30 which extend between the inner wall and the annular panel 29 thereby providing stability and support to the stator 14.

In a known configuration, a conical ledge cover of the stator 14 has a linear cross-sectional profile. The Applicant has established that by altering the profile of the ledge cover to that illustrated in FIG. 1, a reduction in pressure drop at an outlet or downstream portion of the throat 10 can be achieved. In addition, there is a reduction in turbulence experienced at the outlet which means components are subjected to less wear and therefore have a longer life.

Figure 5:
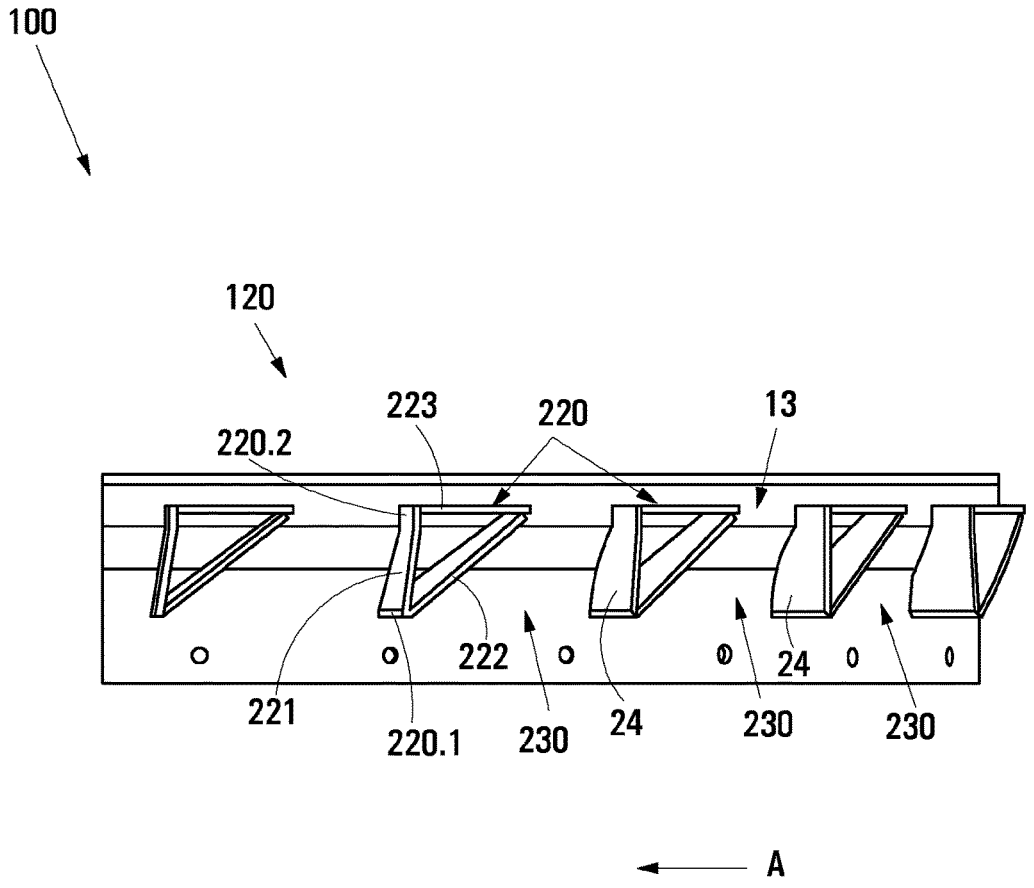
FIG. 5 illustrates a radial view of part of a further embodiment of a rotatable throat in which an outer ring has been omitted for clarity.
Figure 6:
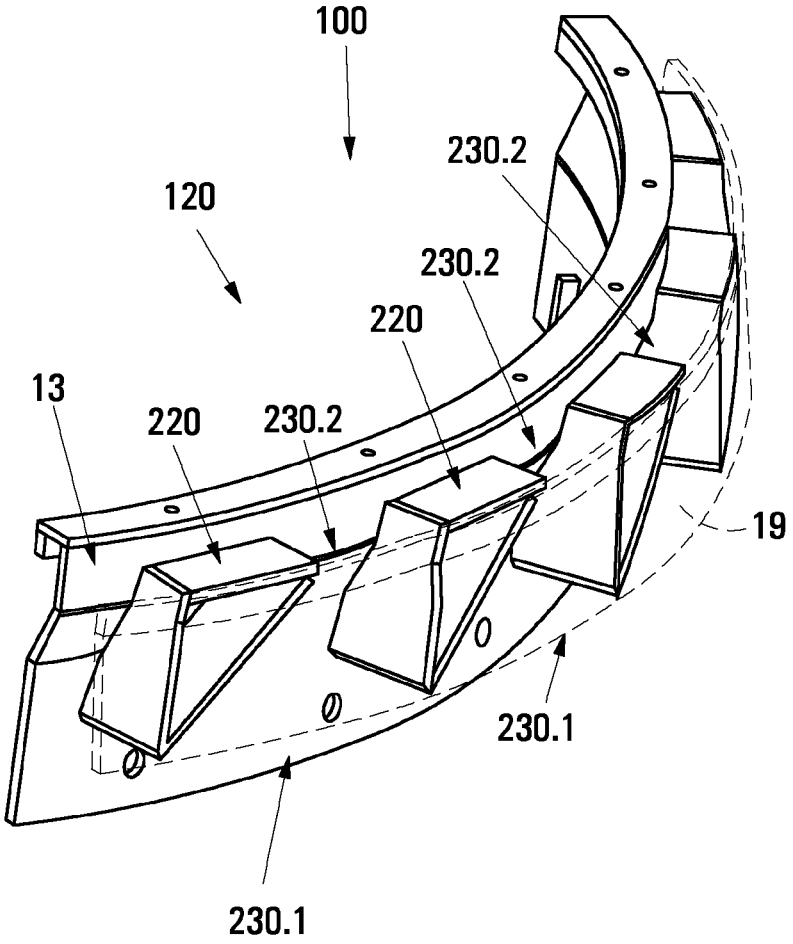
FIG. 6 illustrates a three-dimensional view of the throat shown in FIG. 5.

The invention extends to a further embodiment of a rotatable throat, reference numeral 100 referring generally to this further embodiment of the throat in FIGS. 5 and 6. The same reference numerals used above have again been used below to refer to similar features of the throat 100.

The throat 100 includes a rotor 120 which comprises an inner ring 13 and a plurality of vanes 220 which are angularly spaced apart about an outer periphery of the inner ring 13. Each vane 220 has a triangular profile when viewed radially and has an operatively upstream end 220.1 and an operatively downstream end 220.2. Furthermore, each vane 220 comprises a leading member 221, a trailing member 222, diverging from the leading member 221 in a downstream direction from the upstream end 220.1 and a third downstream member 223 which extends circumferentially between the leading member 221 and the trailing member 222. The leading member 221 is a vane 22 as described above and accordingly has a leading face 24 and an arcuately curved profile when viewed radially. In similar fashion to the vanes 22 described above, the vanes 220 have a non-uniform radial width in the axial direction and taper radially from their upstream end 220.1 to their downstream end 220.2. The third downstream member 223 serves to blank or block a portion of the air port. This allows the vanes 220 to have a greater radial width without this significantly increasing the overall size of the air port or openings provided between the vanes 220. The size and distribution of the third downstream members 223 is such that they collectively cover less than 180° of the 360° degree extent of the air port or less than 50% of the circumferential area of the throat.

Referring now to FIG. 6, the rotatable throat 100 further defines a plurality of openings 230 between the vanes 220, inner ring 13 and outer ring 19. As a result, an upstream inlet opening 230.1 is defined in part by the upstream ends 220.1 of adjacent vanes 220 and a downstream outlet opening 230.2 is defined in part by downstream ends 220.2 of adjacent vanes 220 such that the openings 230 between adjacent vanes 220 progressively decrease in cross-sectional area from the inlet 230.1 to the outlet 230.2.

Figure 7:
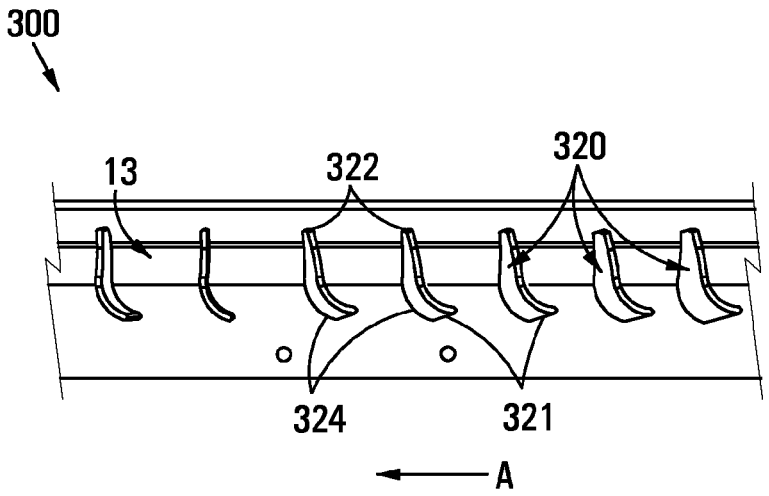
FIG. 7 illustrates a radial view of part of a further embodiment of a rotatable throat in which an outer ring has been omitted for clarity.
Figure 9:
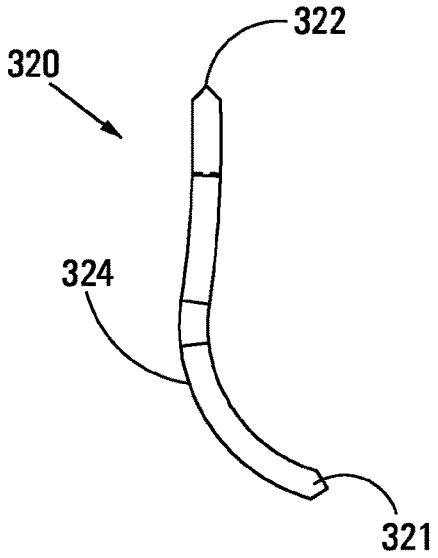
FIG. 9 shows a radial outer side view of the vane of FIG. 8.

A further embodiment of a rotatable throat or port ring is designated by reference numeral 300 in FIG. 7. The throat 300 includes a plurality of regularly spaced apart curved or serpentine vanes 320 which are connected to the inner ring 13, openings being defined between adjacent vanes 320. A leading surface 324 extends between an upstream end 321 and a downstream end 322 of each vane 320. The leading surface 324 exhibits a slight S-shaped curvature which is predominantly convexly curved toward the upstream end 321 and has a marginal concave curvature toward the downstream end 322 (see FIG. 9).

Figure 8:
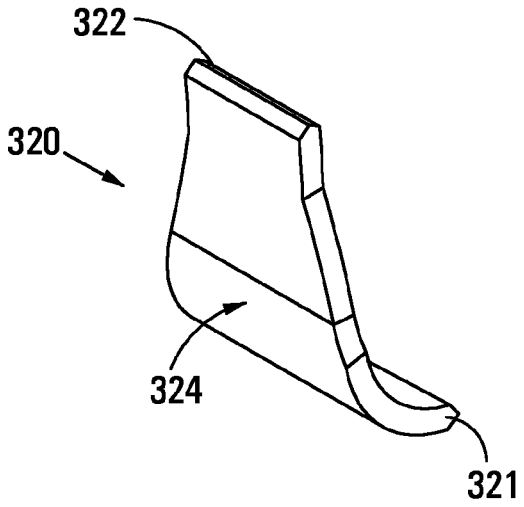
FIG. 8 shows a three-dimensional view of a vane forming part of the throat of FIG. 7.
Figure 10:
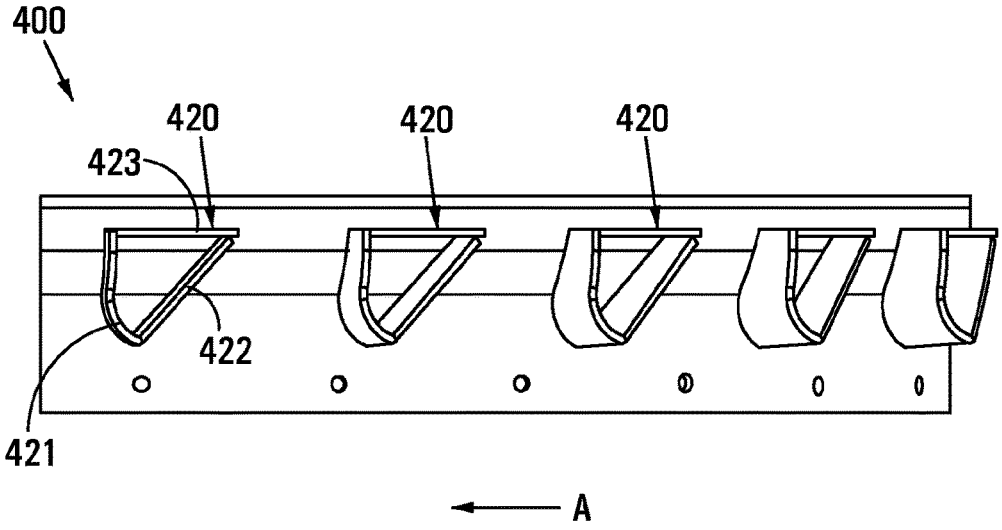
FIG. 10 illustrates a radial view of part of a yet another embodiment of a rotatable throat in accordance with the invention in which the outer ring has once again been omitted for the sake of clarity.

Yet another embodiment of a rotatable throat or port ring in accordance with the invention is designated by reference numeral 400 in FIG. 10. The throat 400 includes a plurality of angularly spaced apart composite vanes 420, each of which comprises a leading member 421, a trailing member 422 and a third downstream member 423. The trailing member 422 diverges from an upstream end of the vane 420 in a downstream direction in similar fashion to the trailing member 222 of the vane 220 of the throat 100. The downstream member 423 extends circumferentially between the leading member 421 and the trailing member 422, joining the members 421, 422 together. The leading member 421 is in the form of the vane 320 illustrated in FIGS. 8 and 9.

The throats 10, 100, 300, 400 in accordance with the invention aim to improve mill performance by optimising air flow through the throats. Air flow velocity through a throat is dependent upon the rotational speed of the grinding ring of the mill and the average air flow velocity at the inlet of the throat. In a known rotatable throat configuration, planar vanes are angled at 60° relative to the horizontal irrespective of the angular velocity of the grinding ring and the air velocity incident upon the throat. Consequently, a vortex forms above the throat which hampers throughput and increases turbulence and component wear. Ideally, a vertical air flow pattern without any swirl is required above the throat in order to optimise performance. It is to be appreciated that air passing through the throat 10, 100 accelerates from the inlet 230.1 to the outlet 230.2. For this reason, the leading face 24 is arcuately curved to account for the change in air velocity across the vanes 22, 220 in order to ensure a vertical resultant air flow at the outlet 230.2. As a result of the slower air flow rate at the upstream end 22.1, 220.1, the first angle $\beta$ at the inlet is greater than the second angle $\alpha$ at the outlet which gives rise to the arcuate profile of the vane 22, 220 (see FIG. 4). Furthermore, the widened upstream end 22.1, 220.1 of the vanes 22, 220 provides for a gradual acceleration through the throat 10, 100 which reduces pressure shock. In the above example embodiment, the number of vanes has been reduced from 64, in previous configurations, to 50 which also contribute to a reduction in pressure drop across the mill. The Applicant believes that a mill including any one of the rotatable throats 10, 100, 300, 400 as described above will enjoy improved performance due to a reduction in pressure drop across the mill.

In the event that flow incident upon the inlet of the throat has a strong flow component in the same direction as rotation of the rotary grinding member, i.e. in the same direction (A) as rotation of the vanes, then the design of the throats 300, 400 illustrated in FIGS. 7 to 10 is preferred. The convexly curved portion of the leading surface 324 toward the upstream end 321 of the vane 320 helps to lead the flow into and through the throat 300, 400 without excessive turbulence. An angle of the upstream end 321 of the vane 320 relative to the horizontal may be determined based upon flow conditions at the inlet and may vary between 20° and 70° relative to the horizontal.

The invention claimed is:

1. A pulveriser mill having: a rotary grinding member and a port ring which is arranged around a periphery of the rotary grinding member for rotation with the rotary grinding member about an axis, the port ring including a plurality of vanes which are angularly spaced about the axis such that openings are defined between the vanes which allows air to flow from below the port ring to above the port ring, at least one of the vanes having an operatively upstream portion and a downstream portion and a non-planar leading surface which extends between the upstream portion and the downstream portion, the port ring having an upstream inlet which is defined in part by upstream ends of adjacent vanes and a downstream outlet defined in part by downstream ends of adjacent vanes such that the openings between adjacent vanes converge or decrease in area from the inlet to the outlet, at least part of the leading surface has a curvature configured such that an angle of said at least part of the leading surface relative to the vertical decreases in the direction of the downstream portion.

2. A pulveriser mill as claimed in claim 1, wherein the leading surface has a concave curvature.

3. A pulveriser mill as claimed in claim 1, wherein the leading surface has a convex curvature.

4. A pulveriser mill as claimed in claim 1, wherein the leading surface has a serpentine curvature.

5. A pulveriser mill having: a rotary grinding member and a port ring which is arranged around a periphery of the rotary grinding member for rotation with the rotary grinding member about an axis, the port ring including a plurality of vanes which are angularly spaced about the axis in a configuration which allows air to flow from below the port ring to above the port ring, at least one of the vanes having an operatively upstream portion and a downstream portion and a non-planar leading surface which extends between the upstream portion and the downstream portion, wherein, at least a portion of the leading surface has a concave curvature configured such that an angle of said at least part of the leading surface relative to the vertical decreases in the direction of the downstream portion.

6. A pulveriser mill as claimed in claim 1, wherein the vane is inclined relative to the vertical and the leading surface extends between the upstream end and the downstream end.

7. A pulveriser mill as claimed in claim 6, wherein a line tangential to the leading surface drawn from one of the upstream end or the downstream end does not pass through the other end when the vane is viewed radially.

8. A pulveriser mill as claimed in claim 7, wherein a line tangential to the leading surface drawn from the upstream end forms a first angle relative to the vertical which is greater than a second angle formed between a line tangential to the leading surface drawn from the downstream end and the vertical, when the vane is viewed radially.

9. A pulveriser mill as claimed in claim 1, wherein at least one of the vanes has a cross-sectional profile which diverges, when viewed radially, from the upstream portion to the downstream portion.

10. A pulveriser mill as claimed in claim 9, wherein each vane has a triangular cross-sectional profile when viewed radially.

11. A pulveriser mill as claimed in claim 9, wherein each vane is a composite vane comprising a first leading member, a second trailing member diverging from the leading member in a downstream direction away from an upstream end of the vane and a third downstream member extending circumferentially between downstream ends of the leading member and the trailing member.

12. A pulveriser mill as claimed in claim 1, in which at least one of the vanes has a non-uniform radial width in the axial direction.

13. A pulveriser mill as claimed in claim 12, wherein the vane is inclined with respect to the vertical, a radial width of the upstream end being greater than a radial width of the downstream end.

14. A pulveriser mill as claimed in claim 13, wherein at least one side of the vane is slanted when the vane is viewed face on.

15. A pulveriser mill as claimed in claim 13, wherein opposing sides of the vane converge toward the downstream end when the vane is viewed face on such that the vane tapers from the upstream end to the downstream end.

16. A method of modifying a pulveriser mill which includes a rotary grinding member and a port ring arranged around a periphery of the rotary grinding member for rotation with the rotary grinding member about an axis, the port ring including a plurality of inclined planar vanes, the method including replacing the port ring with a port ring including a plurality of vanes which are angularly spaced about the axis in a configuration which allows air to flow from below the port ring to above the port ring, wherein at least one of the vanes has an operatively upstream portion and a downstream portion and a non-planar leading surface which extends between the upstream portion and the downstream portion, at least part of the leading surface having a curvature configured such that an angle of said at least part of the leading surface relative to the vertical decreases in the direction of the downstream portion and wherein the port ring defines a plurality of openings between the vanes, the ring having an upstream inlet which is defined in part by upstream ends of adjacent vanes and a downstream outlet defined in part by downstream ends of adjacent vanes such that the openings between adjacent vanes converge or decrease in area from the inlet to the outlet.

17. A pulveriser mill as claimed in claim 1, in which the port ring includes an annular rotor and an annular stator, the rotor including an inner ring which is attached to a grinding member of the pulveriser mill for rotation therewith and an annular outer ring, the vanes extending between the inner and outer rings, the stator being connected to a housing of the mill and defining an annular ledge cover positioned downstream of the vanes, the ledge cover having a pair of axially arranged frusto-conical ledge cover portions, the frusto-conical ledge cover portion which is positioned closer to the vanes being inclined at a steeper angle than the frusto-conical ledge cover portion positioned further from the vanes.

* * * * *